US005860841A

United States Patent [19]

Welz

[11] Patent Number: 5,860,841

[45] Date of Patent: Jan. 19, 1999

[54] PERSONAL WATERCRAFT

[76] Inventor: Jaroslav Welz, 4769 Driftwood Pl., Burnaby, Canada, V5G 4E2

[21] Appl. No.: 986,029

[22] Filed: Dec. 5, 1997

[51] Int. Cl.[6] ..... B63B 35/83

[52] U.S. Cl. ..... 441/76

[58] Field of Search ..... 441/76, 77, 75; 440/21, 101–106

[56] References Cited

U.S. PATENT DOCUMENTS

| | | | |
|---|---|---|---|
| 3,601,828 | 8/1971 | Fairchild . | |
| 3,621,500 | 11/1971 | Senghas | 441/77 |
| 3,716,881 | 2/1973 | Tilings . | |
| 3,750,203 | 8/1973 | Ceccato . | |
| 3,758,898 | 9/1973 | Dougherty . | |
| 3,808,622 | 5/1974 | Webster . | |
| 3,835,494 | 9/1974 | Dougherty . | |
| 4,154,188 | 5/1979 | Flagg . | |
| 4,432,735 | 2/1984 | David . | |
| 4,459,118 | 7/1984 | Schaumann . | |
| 4,527,984 | 7/1985 | Gilbert . | |
| 4,541,809 | 9/1985 | Schaumann . | |
| 4,599,072 | 7/1986 | Pollini et al. . | |
| 4,681,551 | 7/1987 | Morris . | |
| 4,698,039 | 10/1987 | Watson . | |
| 4,731,039 | 3/1988 | Zeiss . | |
| 4,804,345 | 2/1989 | Lee . | |
| 4,897,062 | 1/1990 | Watson . | |
| 4,952,184 | 8/1990 | Graziano . | |
| 5,080,621 | 1/1992 | Nayes . | |
| 5,120,249 | 6/1992 | Fonda . | |
| 5,194,023 | 3/1993 | Stone . | |
| 5,236,381 | 8/1993 | Keogh . | |
| 5,421,759 | 6/1995 | Morin . | |
| 5,558,553 | 9/1996 | Okano . | |
| 5,593,334 | 1/1997 | Thayer . | |

FOREIGN PATENT DOCUMENTS

| | | |
|---|---|---|
| 90106161 | 10/1990 | China . |

*Primary Examiner*—Ed Swinehart
*Attorney, Agent, or Firm*—Oyen Wiggs Green & Mutala

[57] ABSTRACT

A personal watercraft or "water walker" has two independent elongated, narrow floats. One float can be worn on each leg of a user. Each float has an oarlock mounted on a support. The oarlocks each hold an oar. The supports hold the oarlocks in front of the user's body, above outer edges of the floats. The user can glide across the surface of a body of water with an action similar to cross country skiing. The oars prevent back-slip of the non-striding float. The water walker uses both arm and leg propulsion, and thus can provide a user with all around exercise. The floats may each have a main float body coupled to a smaller pontoon. Such floats provide good tracking without requiring the user to adopt an uncomfortably wide stance. The watercraft may optionally have a cross member for linking the two floats together in a parallel spaced apart relationship. A seat is located on the cross member. The watercraft may then be rowed like a standard row boat.

17 Claims, 13 Drawing Sheets

PERSONAL WATERCRAFT

BACKGROUND OF THE INVENTION

1. Field of the Invention

This invention relates in general to recreational personal watercraft and more particularly to water walkers (i.e. personal watercraft having two independent floats which can be individually secured to a person's feet to allow the person to move over the surface of a body of water with a striding motion).

2. Description of the Related Art

The goal of walking on water has attracted many inventors. The personal watercraft known as water walking devices or "water walkers" generally have two independent floats. A user can mount one of the floats to each foot. The user can then travel across water using a motion similar to cross country skiing. A problem with water walkers is that it is difficult to "grip" water. The prior art proposes various ways to make floats which experience more drag when they are moved through the water in a rearward direction than when they are moved through the water in a forward direction. For example, some prior art water walkers have one or more flaps or fins attached to the lower surfaces of their floats. The flaps open and push against the water when the floats are moved rearwardly. Examples of this type of water walker are shown in U.S. Pat. No. 5,236,381 to Keogh and U.S. Pat. No. 5,060,621 to Nayes. Such water walkers are not very efficient. There is significant backslipping and power is provided only by a user's legs. It can also be difficult for users to maintain their balance with this type of water walker.

Some known water walkers provide poles which a user can hold. The poles help the user to stay in balance. The poles may be equipped with flotation devices or paddle plates at their lower ends. U.S. Pat. No. 4,527,964 to Gilbert and U.S. Pat. No. 5,558,553 to Okano describe examples of such poles. The poles help a user to develop some additional forward thrust but such devices are still not very efficient. The float that the user is pushing off from (the "non-striding float") still tends to slip backward through the water.

What is needed is a personal watercraft of the water walker type that allows a user to glide across the surface of a body of water more efficiently than prior art water walkers.

SUMMARY OF THE INVENTION

This invention provides a water walker type of personal watercraft having an oar supported in an oarlock coupled to each of two independent floats. The oars may be used to help to propel the water walker and to counteract backslip of the non-striding float.

Accordingly, one aspect of the invention provides a personal watercraft. The personal watercraft comprises left and right independently movable floats having left and right foot platforms for respectively receiving left and right feet of a user; left and right supports extending upwardly from said left and right floats respectively; and, left and right oarlocks, each capable of receiving an oar, respectively mounted on said left and right supports. The left and right oarlocks are respectively located forwardly, upwardly and outwardly from the left and right foot platforms. In a preferred embodiment the left and right foot platforms are in foot wells in the left and right floats respectively. The floats may comprise a pair of longitudinally extending keels separated by a channel. The floats may also each comprise a main float body and a pontoon coupled in spaced apart parallel relationship to the main float body. A user may place oars in the oarlocks and may then use the oars to assist in propelling the watercraft. The water walker may optionally comprise a cross member detachably affixable to each of said floats and a seat on said cross member. When the cross member is affixed between the floats, the floats are supported in spaced apart parallel relationship in relation to one another. and the water walker may then be rowed like a conventional row boat.

Another aspect of the invention provides a personal watercraft. The water craft comprises first and second independent elongated floats, and an oarlock capable of receiving an oar coupled to each of the floats by a support. Each of the floats has a hull, a front end, a back end, and a means for securing a foot located near a center of buoyancy of the float. Each of the supports holds one of the oarlocks at a position above an upper surface of the float between the front of the float and the means for securing a foot. The supports preferably each comprise a support member pivotally coupled to the float, and a brace member having one end pivotally coupled to the float and a second end coupled to the support member.

Yet another aspect of the invention provides a method for moving across the surface of a body of water. The method comprises the steps of providing a personal watercraft comprising first and second independent narrow and elongated floats and first and second oarlocks mounted respectively on first and second supports connected respectively to said first and second floats; providing first and second oars engaged respectively with said first and second oarlocks; standing with one foot on each of said first and second floats; and then alternating between moving said second float forwardly relative to said first float while simultaneously pushing forwardly on a handle of said first oar to drive a blade of said first oar rearwardly through the water and moving said first float forwardly relative to said second float while simultaneously pushing forwardly on a handle of said second oar to drive a blade of said second oar rearwardly through the water.

BRIEF DESCRIPTION OF THE DRAWINGS

In drawings which illustrate specific embodiments of the invention, but which should not be construed as restricting the spirit or scope of the invention in any way.

DETAILED DESCRIPTION

Figure 1:
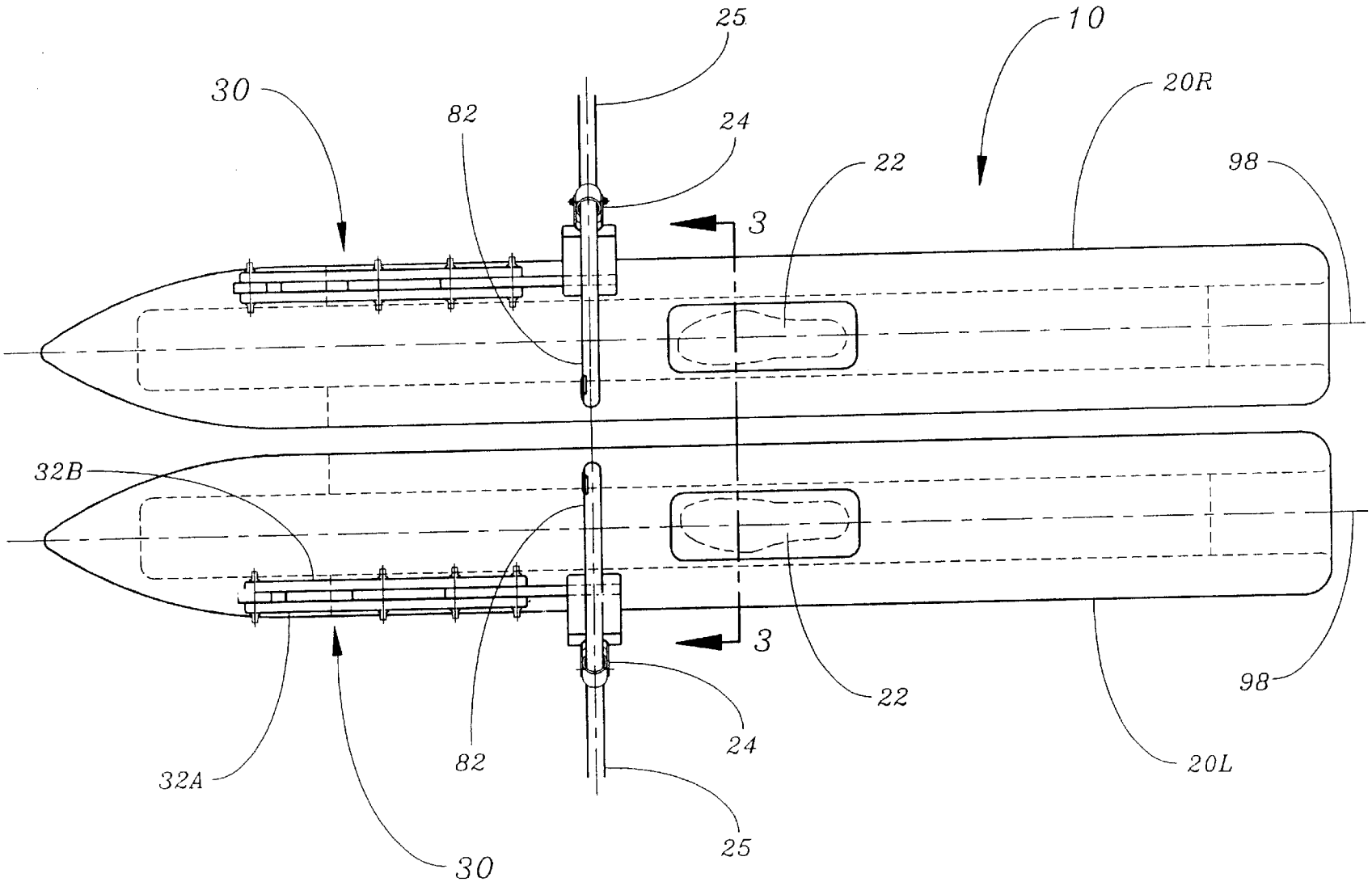
FIG. 1 is a top plan view of a personal watercraft according to a preferred embodiment of the invention.
Figure 2:
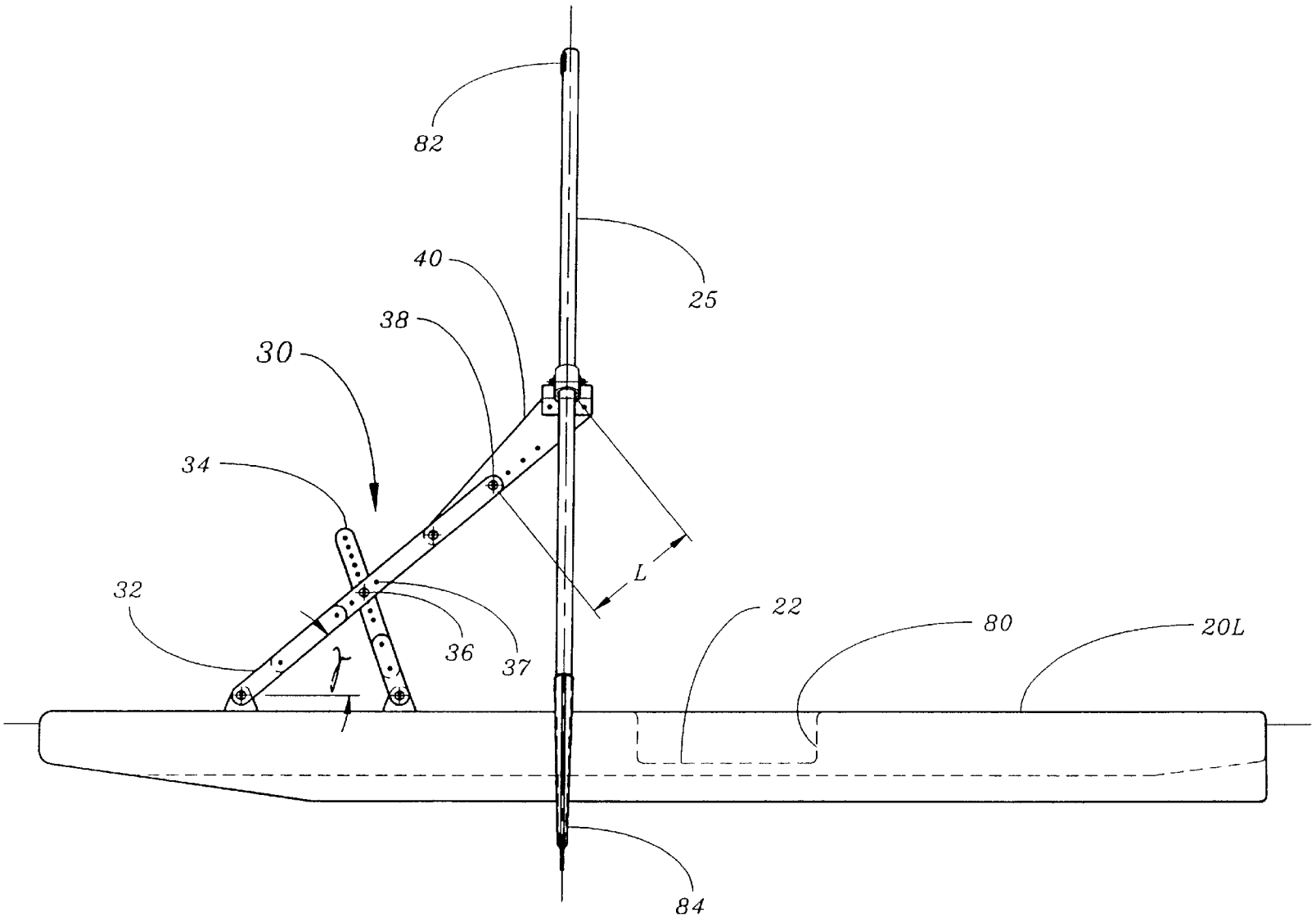
FIG. 2 is a side view thereof.
Figure 3:
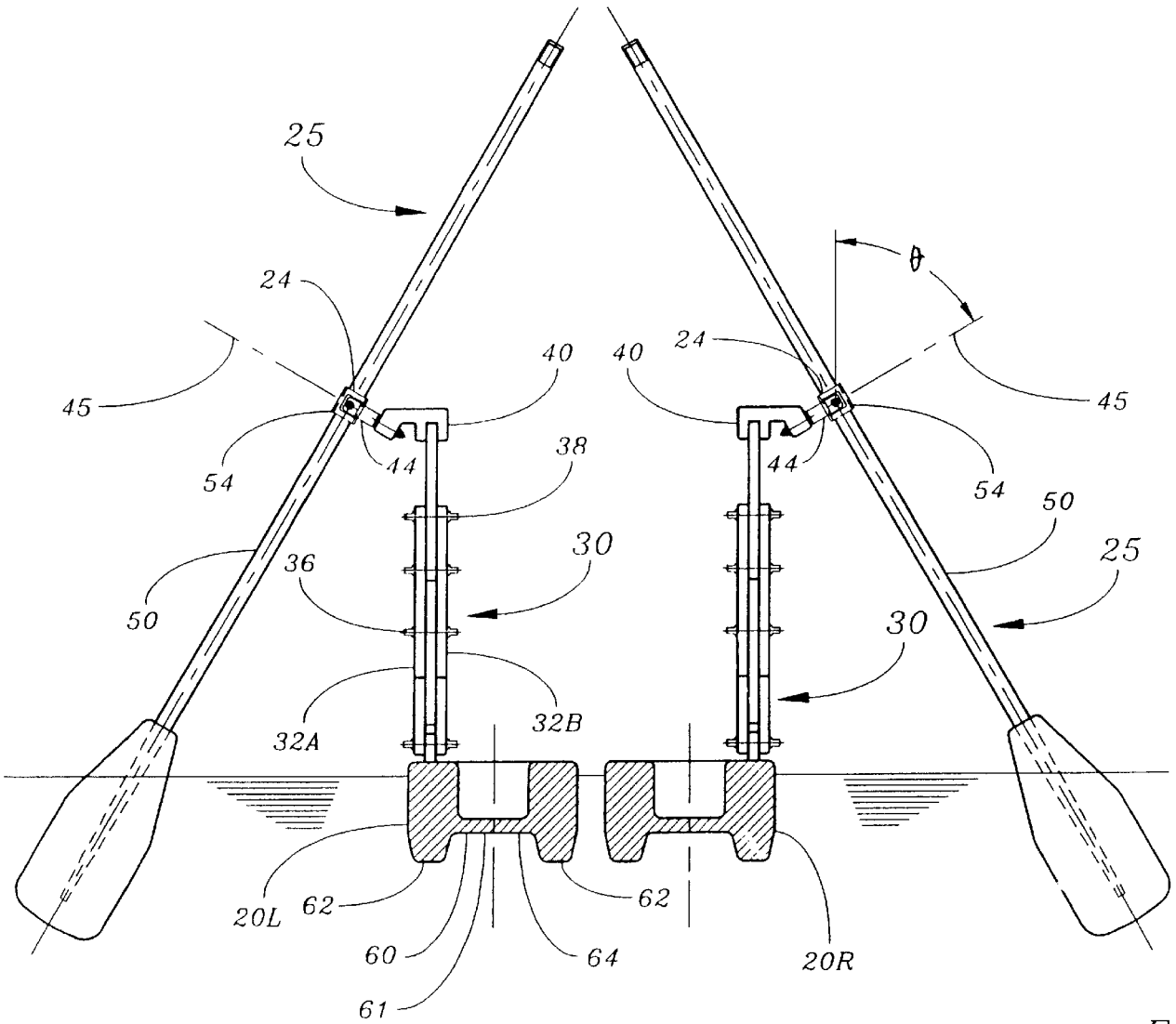
FIG. 3 is a sectional front view, along section line 3—3, thereof.

As shown in FIGS. 1, 2 and 3 a personal watercraft (or "water walker") 10 according to the invention comprises two floats 20L and 20R. In this disclosure the letters "R" and "L" are used to identify parts on the right and left sides of the watercraft respectively. For example, the reference numeral 20R refers to the right hand one of floats 20 and the reference numeral 20L refers to the left hand float 20. Each float 20 has a foot platform 22 for supporting one of a user's feet. Each float 20 has an oarlock 24 supported on a support 30 which extends upwardly from the float. Oarlocks 24 receive oars 25 which a user can use, as described below, to propel watercraft 10 across the surface of a body of water.

Supports 30 support oarlocks 24 forwardly, upwardly and outwardly from foot platforms 22. When a user is standing with his or her left and right feet respectively on foot platforms 22L and 22R, oarlocks 24 are preferably located approximately 25 cm (10 inches) in front of the user's body, about 70 cm (28 inches) above foot platforms 22 and about 25 cm (10 inches) outwardly from a longitudinal axis 98 passing through the center of the respective one of foot platforms 22R, 22L. These dimensions are only informative. Supports 30 are preferably adjustable to allow the positions of oarlocks 24 to be varied to suit an individual user.

Supports 30 preferably each comprise an elongated first member 32 pivotally mounted to the respective float 20 at a point well forward from foot platform 22. A second brace member 34 has one end pivotally mounted to float 20 and a second end coupled to first member 32. The point of connection of first member 32 and brace member 34 is preferably adjustable so that the elevation of oarlock 24 above float 20 may be adjusted by changing the angle y of inclination of first member 32. This may be accomplished, for example, by forming first member 32 from a pair of spaced apart arms 32A and 32B. Brace member 34 passes between arms 32A and 32B of support member 32 and is fixed in place by a pin 36 which passes through apertures 37 in arms 32A and 32B of support member 32 and brace member 34. A series of spaced apart apertures 37 may be provided in each of support member 32 and brace member 34 to enable the point of connection of support member 32 and brace member 34 to be varied.

Support member 32 is preferably adjustable in length. This may be accomplished, for example, by mounting oarlock 24 to a member 40 which is secured between arms 32A and 32B by bolts 38. The distance L by which member 40 projects past arms 32A, 32B can be adjusted by removing bolts 38, altering the insertion length of member 40 between arms 32A and 32B and replacing bolts 38. It can be appreciated that this design provides supports 30 which can securely, and reasonably rigidly, support oarlocks 24 and yet allow the locations of oarlocks 24 to be adjusted both in elevation and in position fore and aft relative to float 20 to suit the physique and preferences of a user. A support 30 as described above may be collapsed to a compact storage configuration by removing pin 36. The dimensions of support member 32 and brace member 34 and the locations at which these members are attached to floats 20 are most preferably selected so that $\gamma$ is in the range of about 30 degrees to about 60 degrees when support 30 is in use.

Figure 4A:
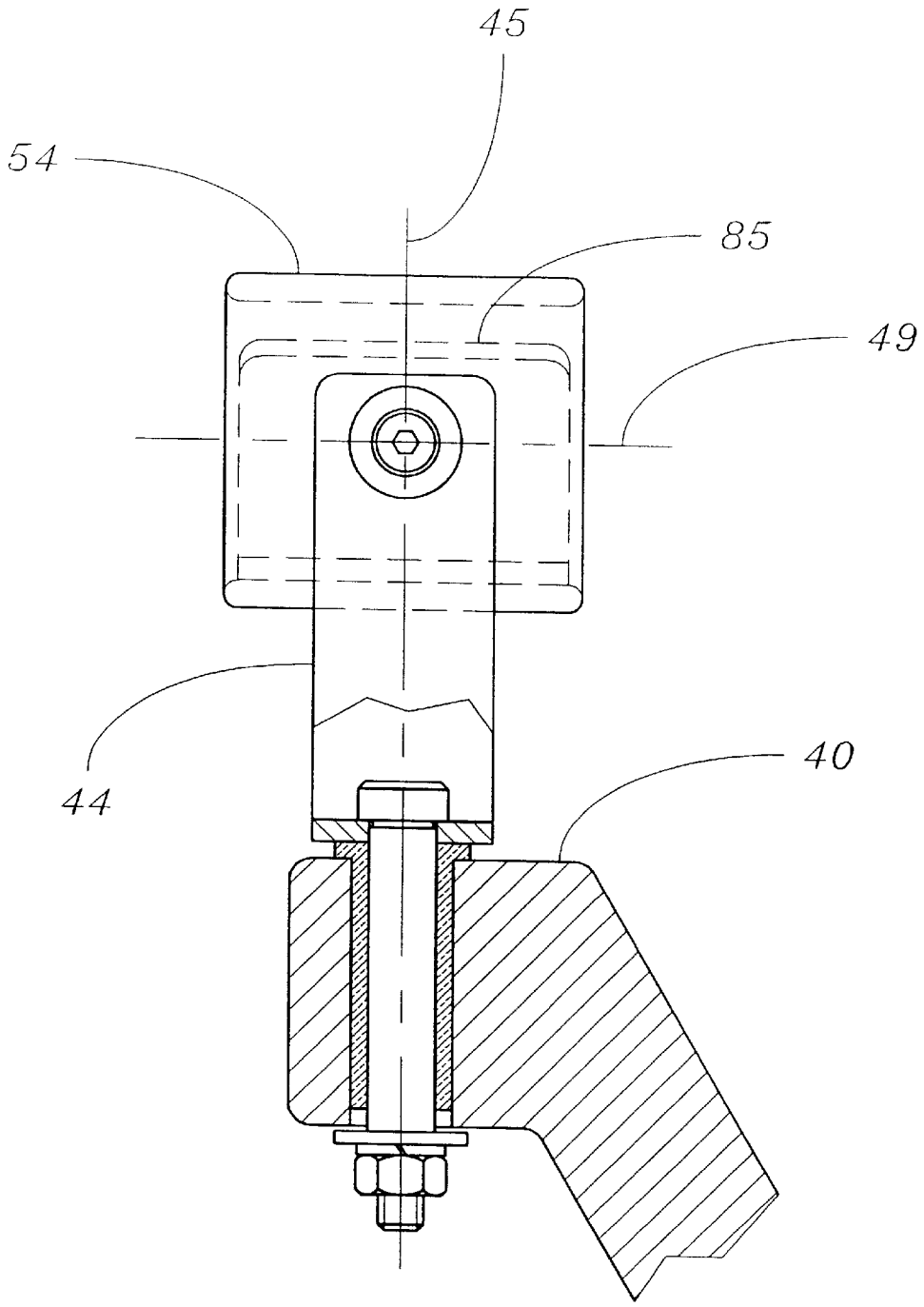
FIGS. 4A and 4B are detailed views of an oarlock for use in the invention.
Figure 4B:
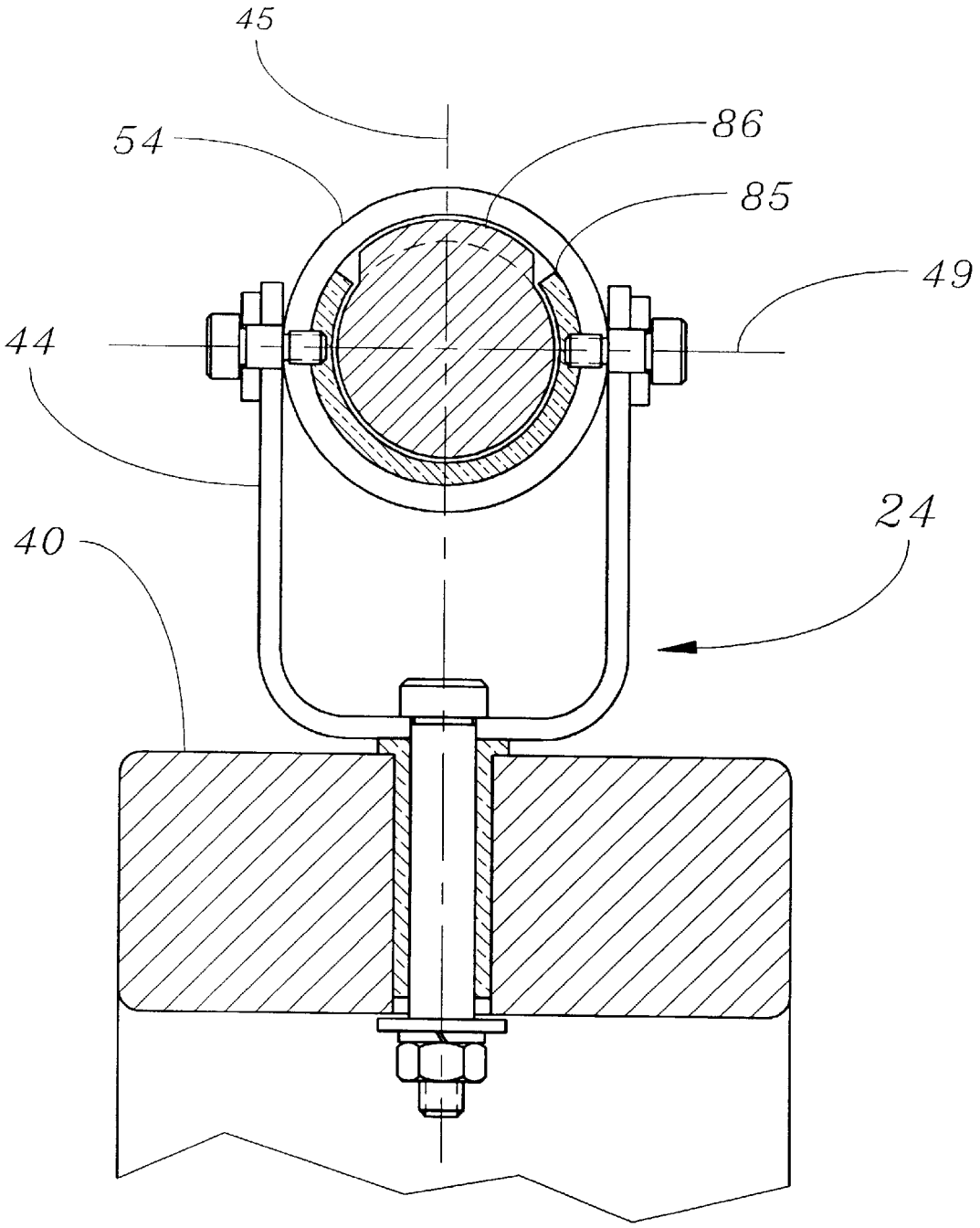

Oarlocks 24 are mounted to the upper ends of members 40. As best shown in FIGS. 4A and 4B, each oarlock 24 comprises a clevis 44 pivotally secured to its member 40 for rotation about axis 45 which is preferably inclined outwardly at an angle $\theta$ in the range of about 40 degrees to about 80 degrees, and most preferably about 60 degrees (FIG. 3.). Oar 25 may then be pivotally mounted to each clevis 44. For example shaft 50 of each oar 25 may be received within tube 54 which is, in turn, pivotally secured to clevis 44. Those skilled in the art will realize that there are many possible designs of oarlocks 24 and oars 25 which may suitably be used in the invention. For example, each oar 25 may simply be received between the arms of clevis 44. What is needed is that oarlock 24 acts as a fulcrum supported by a support 30 for an oar 25 to be worked against. Oarlocks 24 are preferably of the universal joint type so that oars 25 can be smoothly pivoted about two perpendicular axes 45, 49. This permits a user to swing oars 25 out of the water on their return strokes, as discussed below.

Oars 25 typically resemble paddles. Preferably each oar 25 comprises a shaft 50, which can be slidably received in tube 54 of an oarlock 24. A hand grip 82 is provided at one end of shaft 50. A blade 84, preferably having a wide, flat shape is located at the other end of shaft 50. Oars 25 are preferably just long enough so that blades 84 are immersed in water when a user is standing on floats 20 with grips 82 at shoulder level and shafts 50 engaged in oarlocks 24.

Most preferably, oars 25 are retained in oarlocks 24 so that oars 25 will not be lost if a user lets go of them momentarily. Those skilled in the art will realize that there are numerous ways to retain an oar 25 in an oarlock 24. For example, a grooved sleeve 85 may be inserted into each tube 54 creating a key hole shaped aperture 86. Grips 82 of oars 25 may be shaped to pass through aperture 86 only when aligned properly with aperture 86. Oars 25 may be held in place in oarlocks 24 by inserting them through sleeves 85 and then rotating them.

Each float 20 is typically about 210 cm to 240 cm (7 feet to 8 feet) long and about 30 cm (1 foot) wide. These dimensions can vary considerably without departing from the scope of the invention. The preferred dimensions for floats 20 depend on the intended user's size, weight and skills. In general, longer and narrower floats 20 are capable of developing higher speeds while shorter and wider floats 20 provide better stability. The volume and weight of each float 20 must be sufficient so that the combined buoyancy of floats 20R and 20L is sufficient to support the weight of a user without sinking. Preferably each float 20 has enough buoyancy to support the weight of a user.

Floats 20 may have various forms. In one preferred embodiment, as shown best in FIG. 3, the lower surface 60 of each float 20 comprises a pair of longitudinally extending keels 62 separated by a channel 64. The bottom 60 of each float 20 in channel 64 is preferably about 7.5 cm (3") above the lowest point of keels 62. The bottom 60 of each float 20 is preferably ramped upwardly at both the front and rear ends of floats 20. Each float 20 is pointed at its front end. This design tends to improve the stability of floats 20. Preferably keels 62 are sufficiently buoyant that when a user has shifted his or her weight to the other float 20 in preparation for thrusting float 20 forward the portion 61 of lower surface 60 in channel 64 is above the water surface. This tends to reduce drag on float 20.

Figure 5:
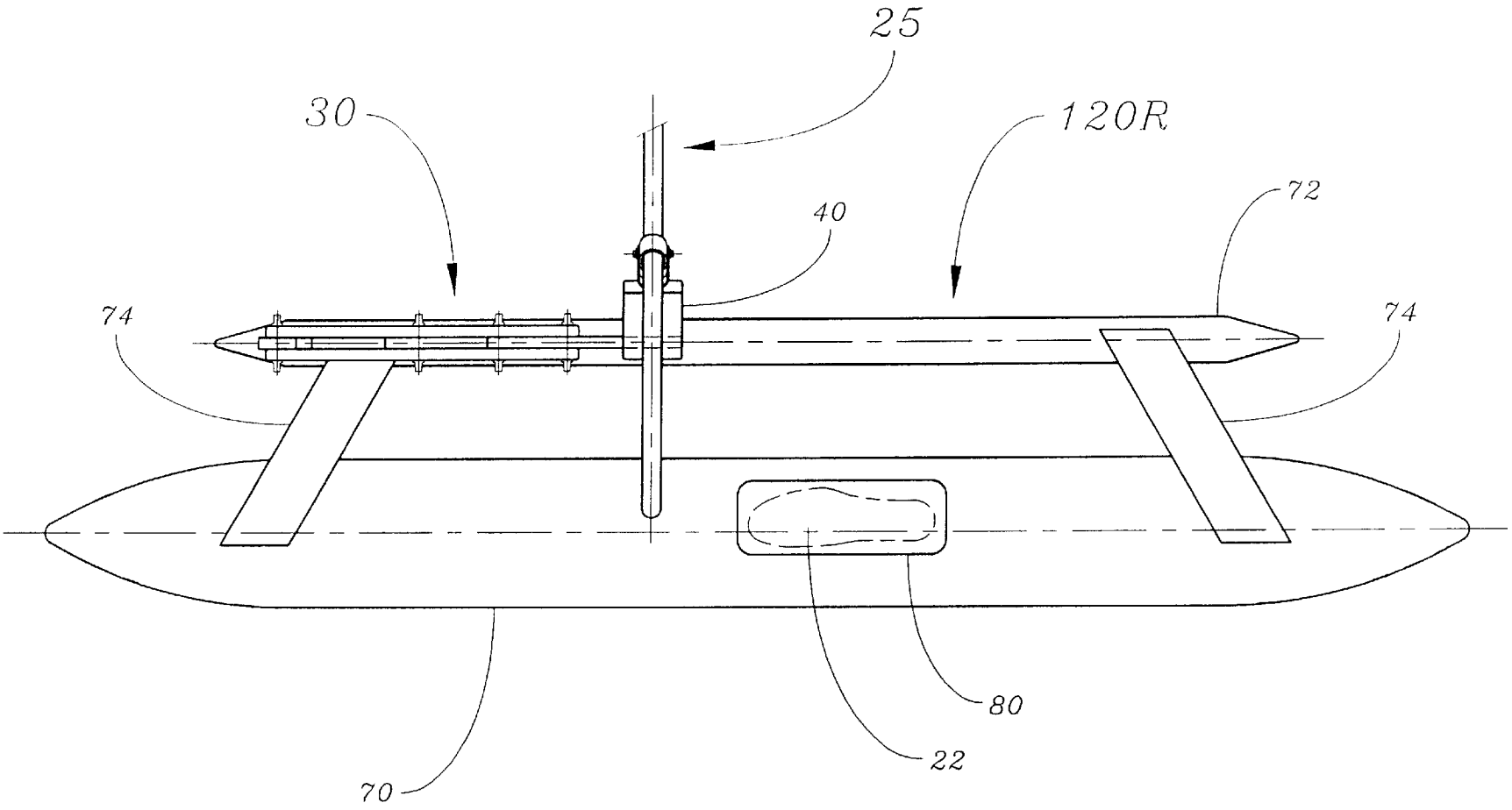
FIG. 5 is a top plan view of an outrigger style float according to an alternative embodiment of the invention.
Figure 6:
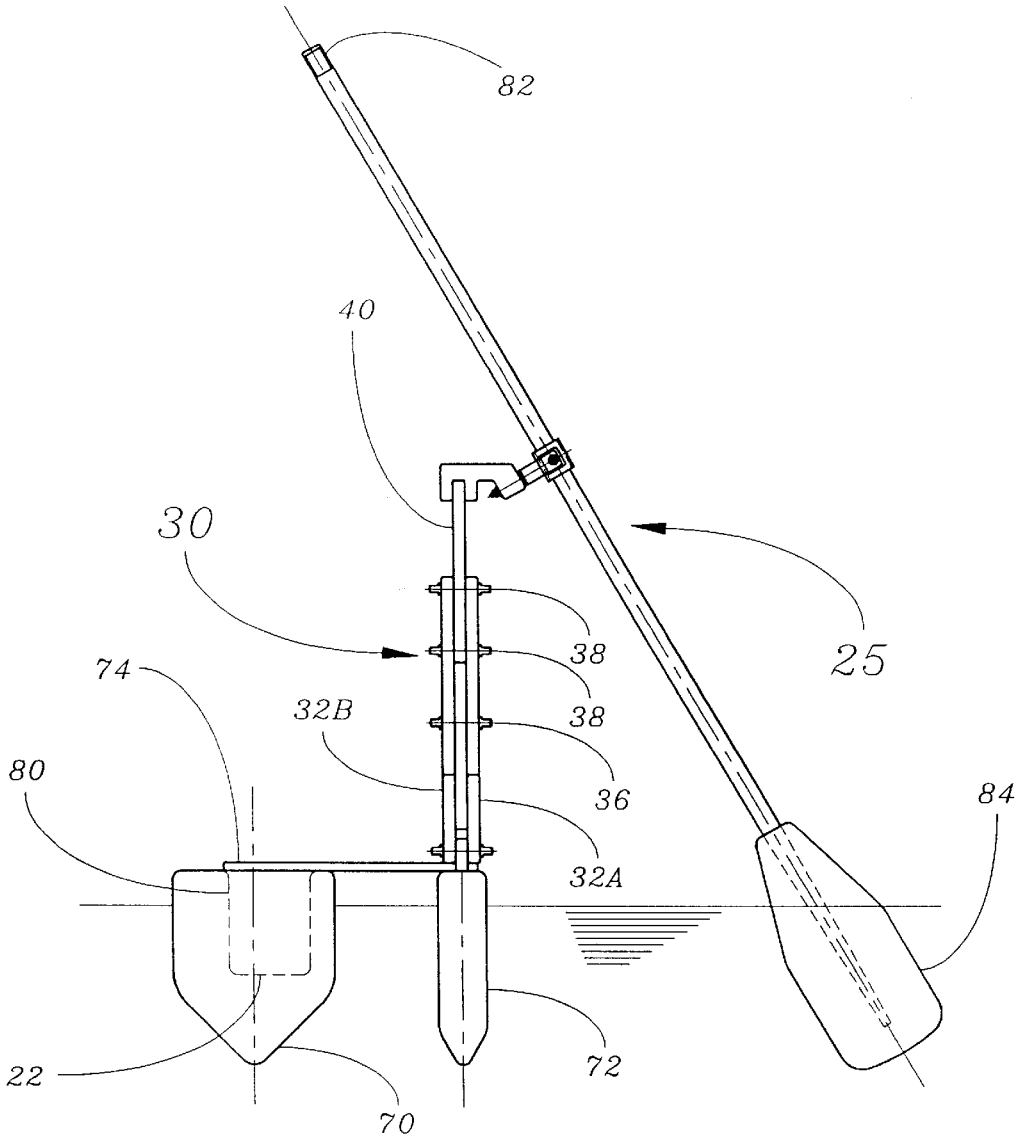
FIG. 6 is a front view thereof.

An alternative float configuration is illustrated by floats 120 of FIGS. 5 and 6. Floats 120 comprise a main float body 70 and a narrow stabilizing outrigger pontoon 72 connected to main float body 70 by cross members 74. Outrigger pontoon 72 is on the outside of main float body 70. For example, on left float 120L, outrigger pontoon 72L is on the left hand side of main float body 70L. Support 30 is preferably mounted to pontoon 72. This embodiment has the advantage of being more stable for the user without producing excessive drag. This embodiment also provides a stable platform for a user without forcing the user to adopt an unnaturally wide spacing between his or her feet. In a float 120 foot platform 22 is preferably offset slightly in main float body 70 toward pontoon 72.

Floats 20 or 120 may be made with any suitable construction. Each float 20 or 120 may, for example, be in the form of a shell of a composite material or plastic defining a hollow hull, a member made of closed cell foam or the like.

Watercraft 10 preferably includes some means for securing a user's foot to each foot platform 22. Most preferably, each foot platform 22 is located in a foot well 80 dimensioned to receive a user's foot and lower leg. Each foot platform 22 is preferably located low in its float 20 for stability. Foot wells 80 conform closely enough to a user's feet to allow the user to smoothly move floats 20 through the water. In the alternative, one or more straps may be provided to hold a user's foot in place on foot platform 22. The means used to keep a user's foot on foot platform 22 should be very easily releasable to enable a user to quickly and surely remove his or her foot from floats 20 in case of capsize.

Figure 7:
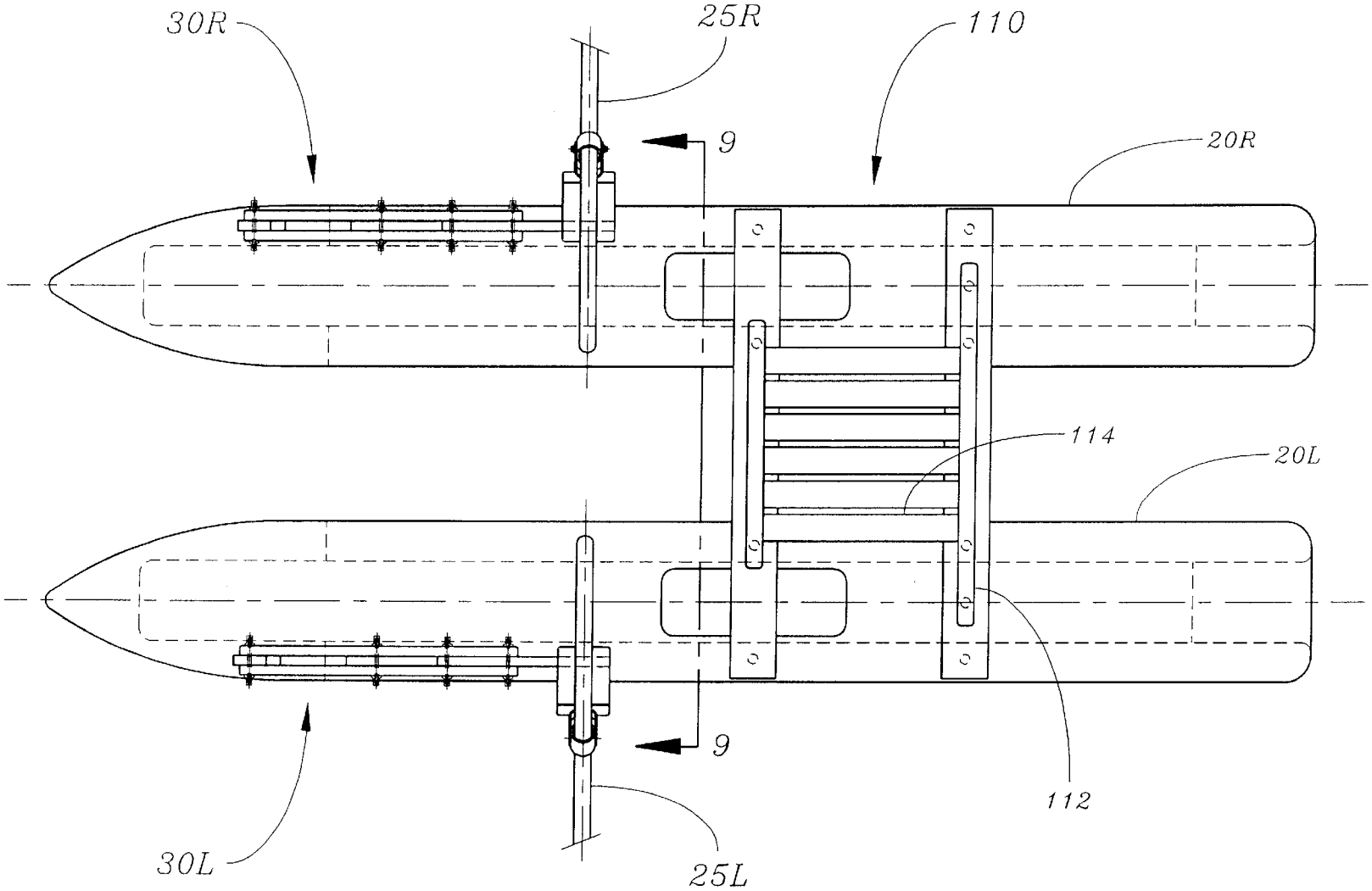
FIG. 7 is a top plan view of an embodiment of the invention which may be converted to a rowing boat.
Figure 8:
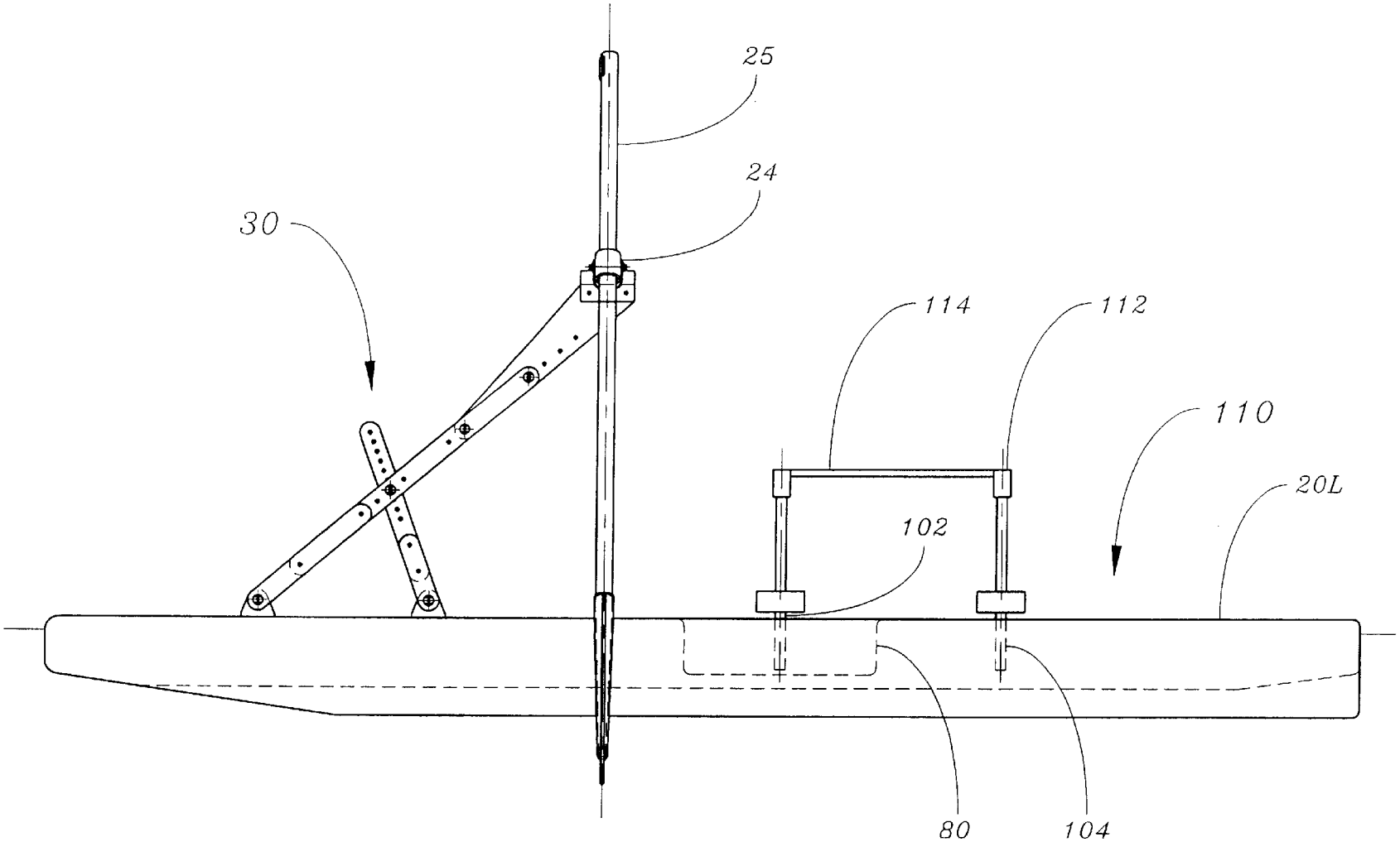
FIG. 8 is a side plan view thereof.
Figure 9:
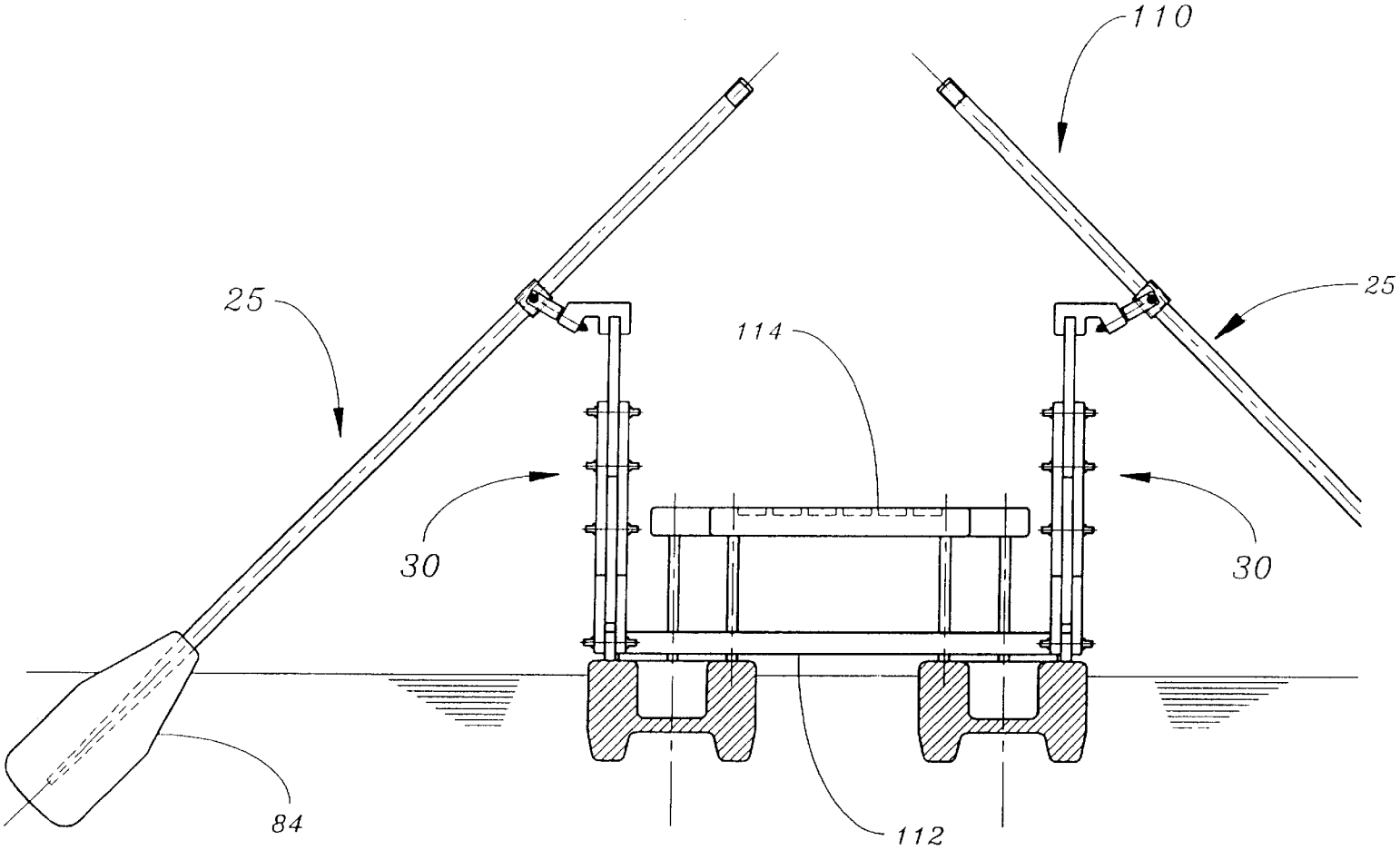
FIG. 9 is a sectional front view, along section line 9—9, thereof.

FIGS. 7, 8 and 9 show a watercraft 110 according to an alternative embodiment of the invention. Watercraft 110 includes one or more detachable cross members 112 which may be used to secure a pair of floats 20 together in a fixed parallel relationship. When floats 20 are secured by cross member 112 then personal watercraft 110 may be used as a catamaran style rowing boat. A seat 114 is located between floats 20 on cross members 112. Cross members 112 preferably comprise elongated pins 102 at either end. Pins 102 are slidingly and fairly snugly received in corresponding shafts 104 in floats 20. Cross members 112 preferably support floats 20 approximately 60 cm (2 feet) apart and parallel to each other. The height and positions of oarlocks 24 may be adjusted by adjusting supports 30 to fit the new rowing style. With cross members 112 in place, watercraft 110 may be rowed in a conventional manner. Watercraft 110 may be converted back into a water walker by simply removing cross members 112.

Figure 10A:
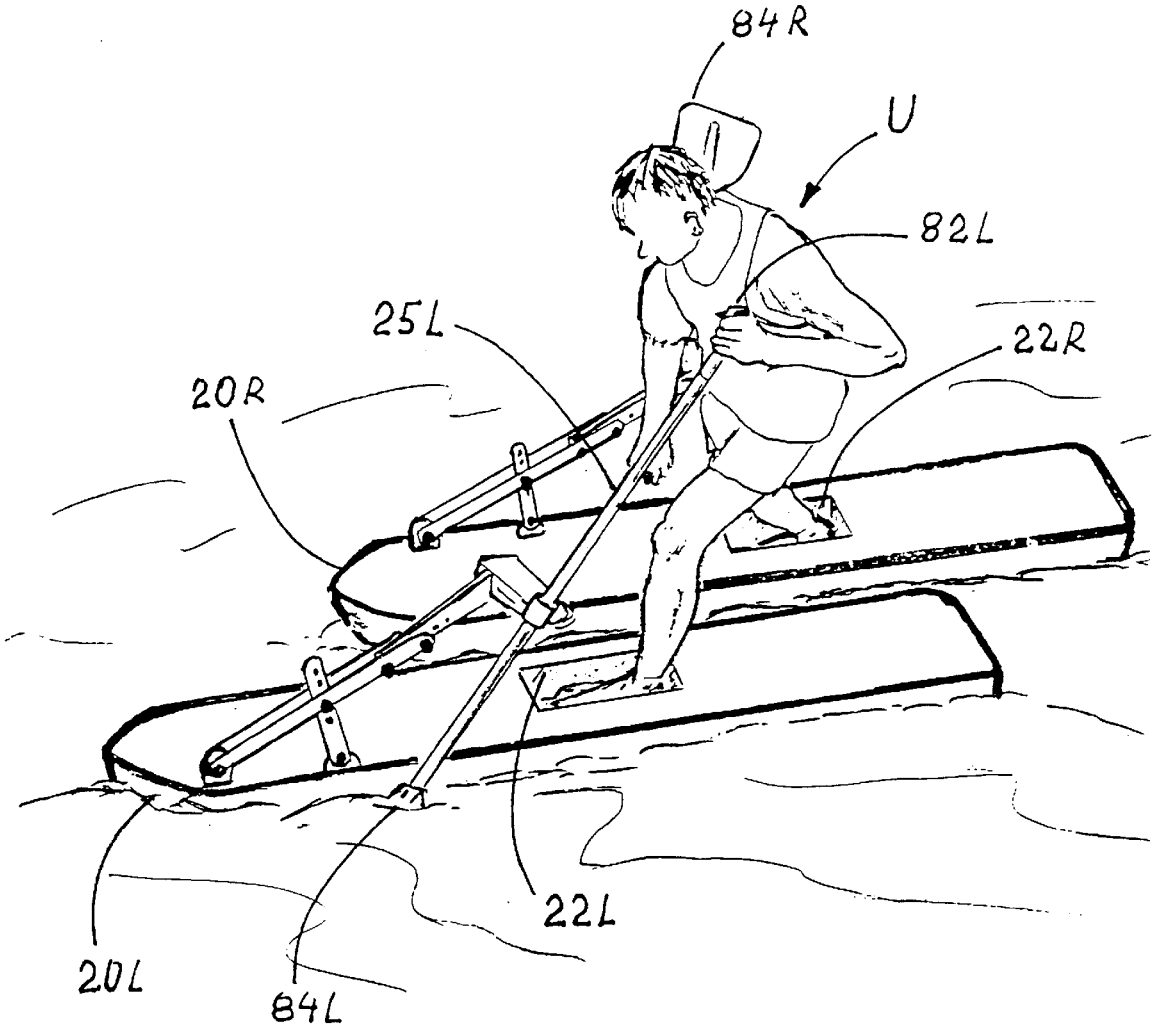
FIGS. 10A, 10B and 10C demonstrate a sequence of steps in the use of the invention to glide across a body of water.

Now that the basic construction of a personal watercraft according to the invention has been described, a method of use thereof will be explained with reference to FIGS. 10A, 10B and 10C. As shown in FIG. 10A, a user U begins by standing facing forward on floats 20 with his left foot on foot platform 22L and his right foot on foot platform 22R. The user shifts his weight onto one float (for example float 20L) and thrusts the other float 20R forwardly. At the same time, the user will push handgrip 82L forwardly to sweep blade 84L of oar 25L through the water. The thrust provided by oar 25L prevents float 20L from backsliding. Blade 84R may be held out of the water by moving its hand grip 82R downwardly. Blade 84R may be moved into position for the next stroke by moving its handgrip 82R rearwardly.

Figure 10B:
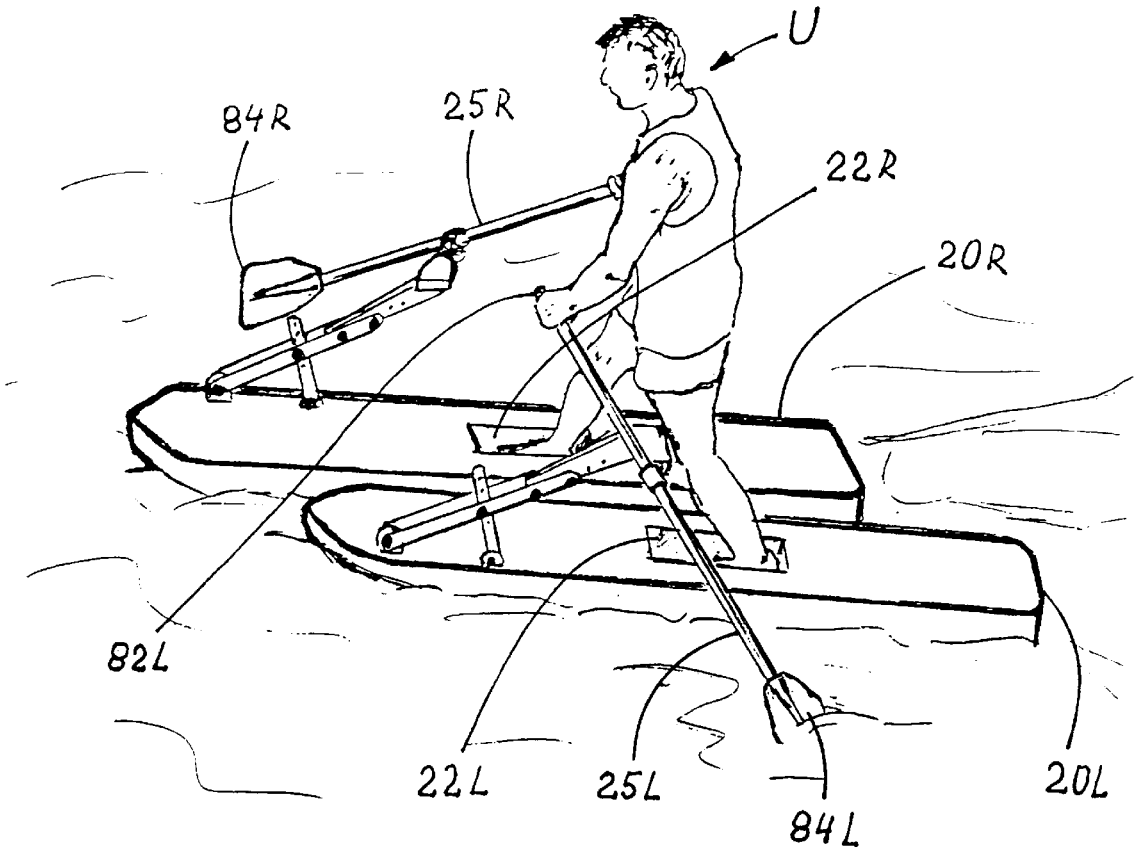
Figure 10C:
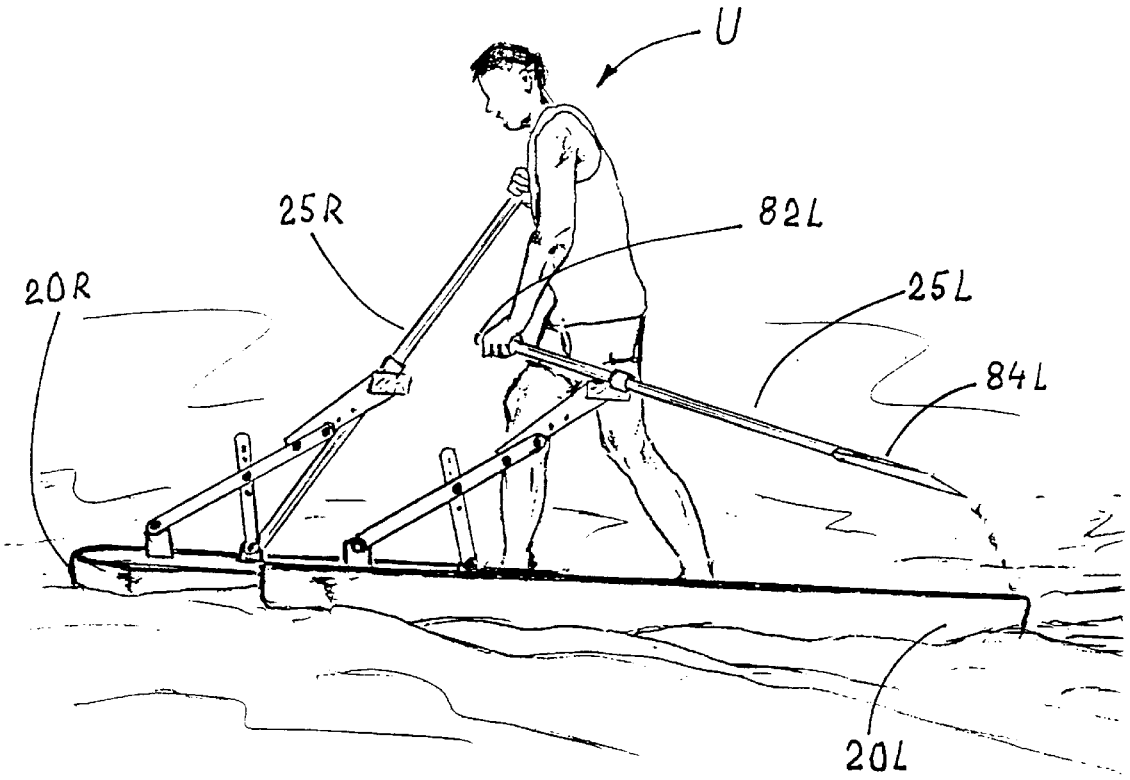

Next, as shown in FIG. 10B, the user U continues to glide forwardly and begins to shift his weight toward float 20R. Oar 25R is in position for a stroke. Oar 25L is leaving the water at the end of its stroke. As shown in FIG. 10C, when most of the user's weight is on float 20R the user thrusts float 20L forwardly. At the same time, the user pushes forward on hand grip 82R to sweep blade 84R through the water and pulls back on hand grip 82L to move blade 84L into position for another stroke. Those familiar with cross country skiing will appreciate that the method of walking across water using a water walker 10 is very similar to cross country skiing and will provide exercise to a users legs and arms.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A personal watercraft comprising:

(a) left and right independently movable floats having left and right foot platforms for respectively receiving left and right feet of a user;

(b) left and right supports extending upwardly from said left and right floats respectively; and, (c) left and right oarlocks respectively mounted on said left and right supports, the left and right oarlocks respectively located forwardly, upwardly and outwardly from the left and right foot platforms, each of said left and right oarlocks capable of acting as a fulcrum for an oar.

2. A watercraft as defined in claim 1 wherein said supports each comprise:

(a) a support member, said support member having a first end and a second end, said first end of said support member pivotally attached to said float at a point proximate to said front end of said float, said support member having a plurality of apertures, said second end of said first member coupled to said oarlock;

(b) a brace member, said brace member having a first end pivotally attached to said float at a point proximate to said foot platform, and a second end, said second end of said brace member detachably secured to said first member by a fastener passing through an aperture in said second end of said brace member and one of said apertures in said support member.

3. The personal watercraft of claim 1 wherein said floats each comprise a foot well and said left and right foot platforms are in said foot wells in said left and right floats respectively.

4. The personal watercraft of claim 1 wherein said floats each comprise a pair of longitudinally extending keels separated by a channel.

5. The personal watercraft of claim 1 wherein said floats each comprise a main float body and a pontoon coupled in spaced apart parallel relationship to said main float body.

6. The personal watercraft of claim 5 wherein said left and right supports are connected to said pontoons on said left and right floats respectively.

7. The personal watercraft of claim 1 wherein each of said oarlocks comprise a clevis pivotally mounted to said support for rotation about an axis of rotation inclined at an angle in the range of 40 degrees to 80 degrees to the vertical.

8. The personal watercraft of claim 1 comprising a cross member detachably affixable to each of said floats and a seat on said cross member, wherein, when said cross member is affixed to said floats, said floats are supported in spaced apart parallel relationship in relation to one another.

9. A personal watercraft comprising:

(a) first and second independent elongated floats, each of said floats having a hull, a front end, a back end, and a means for securing a foot located near a center of buoyancy of said float; and (b) an oarlock capable of receiving an oar coupled to each of said floats by a support, each said support supporting each said oarlock at a position above an upper surface of said float between said front of said float and said means for securing a foot.

10. A watercraft as defined in claim 9 wherein said supports each comprise a support member pivotally coupled to said float, and a brace member having one end pivotally coupled to said float and a second end coupled to said support member.

11. A watercraft as defined in claim 9 wherein each of said floats comprises a main float body and a narrow elongated pontoon supported in parallel spaced apart relation to said main float body, and said means for securing a foot is located on said main float body.

12. A watercraft as defined in claim 9 wherein said means for securing a foot comprises a foot well in said float.

13. A watercraft as defined in claim 12 wherein said supports each comprise:

(a) a support member, said support member having a first end and a second end, said first end of said support member pivotally attached to said float at a point proximate to said front end of said float, said support member having a plurality of apertures, said second end of said first member coupled to said oarlock;

(b) a brace member, said brace member having a first end pivotally attached to said float at a point located proximate to said foot well and a second end, said second end of said brace member detachably secured to said first member by a fastener passing through an aperture in said second end of said brace member and one of said apertures in said support member.

14. A watercraft as defined in claim 9, wherein said oarlocks each comprise:

(a) a clevis, said clevis pivotally secured to said support; and, (b) a tube pivotally secured to said clevis.

15. A watercraft as defined in claim 14, comprising an oar received in each of said oarlocks, wherein each of said oars comprises a shaft, a blade at one end of said shaft and a hand grip at a second end of said shaft.

16. A watercraft as defined in claim 15, further comprising:

(a) a plurality of cross-members, said cross-members having a first end and a second end, said first end of said cross-members secured to said first float, said second end of said cross-members secured to said second float, said first float secured relative to said second float;

(b) a seat, said seat having two ends, said first end of said seat secured to said first end of said cross members, said second end of said seat secured to said second end of said cross members.

17. A method for moving across the surface of a body of water, the method comprising the steps of:

a) providing a personal watercraft comprising first and second independent narrow and elongated floats and first and second oarlocks mounted respectively on first and second supports connected respectively to said first and second floats;

b) providing first and second oars engaged respectively with said first and second oarlocks;

c) standing with one foot on each of said first and second floats with said first and second floats floating on the water; and then d) alternating between:

i) moving said second float forwardly relative to said first float while simultaneously pushing forwardly on a handle of said first oar to drive a blade of said first oar rearwardly through the water; and, ii) moving said first float forwardly relative to said second float while simultaneously pushing forwardly on a handle of said second oar to drive a blade of said second oar rearwardly through the water.

* * * * *